United States Patent [19]

Gomoll et al.

[11] Patent Number: 4,889,270

[45] Date of Patent: Dec. 26, 1989

[54] DEVICE FOR THE PAPER TRANSPORT OF SINGLE SHEETS AND/OR CONTINUOUS PAPER IN OFFICE MACHINES, IN PARTICULAR IN MATRIX PRINTERS

[75] Inventors: Günter Gomoll, Nersingen/Leibi; Wolfgang Hauslaib, Langenau, both of Fed. Rep. of Germany

[73] Assignee: Mannesmann Aktiengesellschaft, Düsseldorf, Fed. Rep. of Germany

[21] Appl. No.: 159,775

[22] Filed: Feb. 24, 1988

[30] Foreign Application Priority Data

Feb. 24, 1987 [DE] Fed. Rep. of Germany ..... 3705857

[51] Int. Cl.[4] ..... B65H 20/00

[52] U.S. Cl. ..... 226/181

[58] Field of Search ..... 226/181, 186, 187, 190, 226/194; 400/617, 636.3; 101/228

[56] References Cited

U.S. PATENT DOCUMENTS

| | | | |
|---|---|---|---|
| 2,849,230 | 8/1958 | Darly et al | 226/186 X |
| 3,073,590 | 1/1963 | Romeo et al. | 226/187 X |
| 3,330,458 | 7/1967 | Bentzman | 226/187 X |
| 3,561,658 | 2/1971 | McDermott | 226/186 X |
| 4,688,958 | 8/1987 | Tajima | 400/636.3 |

FOREIGN PATENT DOCUMENTS

| | | | |
|---|---|---|---|
| 2430929 | 4/1975 | Fed. Rep. of Germany | 226/186 |

*Primary Examiner*—Thomas R. Hannon

*Attorney, Agent, or Firm*—Horst M. Kasper

[57] ABSTRACT

In a device for the paper transport of single sheets and/or continuous paper in office machines, in particular in matrix printers, there are provided in pairs and at least separately driven friction rolls (1, 2) which are disposed rotatably in side plates; the friction rolls exhibit a length to diameter ratio of from 30:1 to 50:1 and are therefore very long and very thin.

In order to provide the friction force in a uniform manner over the entire length of the very long and thin friction rolls, it is disclosed that the positive running bending line (16) of a first feed roll (1) based on its support forces (**14*a*, 14*b*) in the printer frame (15) and the negative running bending line (17) of a second friction feed roll (2) based on its support forces (14*a*, 14*b*) in the printer frame (15) are tuned to each other such that the two bending lines (16, 22**) run approximately parallel.

20 Claims, 2 Drawing Sheets

DEVICE FOR THE PAPER TRANSPORT OF SINGLE SHEETS AND/OR CONTINUOUS PAPER IN OFFICE MACHINES, IN PARTICULAR IN MATRIX PRINTERS

BACKGROUND OF THE INVENTION

1. The invention relates to a device for the transport of paper of individual sheets and/or endless webs in office machines, in particular in matrix printers, with friction rolls rotatably supported in side plates and at least individually driven, which friction rolls are provided in pairs and which friction rolls exhibit a ratio of length to diameter of from about 30:1 to 50:1.

2. Brief Description of the Background of the Invention Including Prior Art

In case of printers with from 80 to 136 characters per line, i.e. for example 10 characters per inch, and larger line widths, there result large distances of the side plates, wherein the friction rolls are rotatably supported. Correspondingly, there result long and thin friction rolls. The consequence of this is that the press-on forces decrease substantially toward the center of the rolls. Based on this situation, an inserted individual sheet is pulled in in a canted way.

The state of the art provides for this purpose individual spring-supported rolls which replace long thin feed rolls. Such spring-supported individual rolls however do not result in a straight pull-in of the paper, where these rolls can be adjusted as desired by the operating personnel and where these rolls are therefore in most cases placed in an asymmetric manner.

SUMMARY OF THE INVENTION

Purposes of the Invention

It is an object of the invention to provide friction roll pairs where the friction is substantially uniform over the entire length of the friction roll.

It is another object of the invention to provide long thin friction roll pairs, which allow a reliable and straight pull-in of the paper.

It is yet another object of the invention to provide a support structure for friction rolls which ensure a reliable relative position of the friction roll.

These and other objects and advantages of the present invention will become evident from the description which follows.

BRIEF DESCRIPTION OF THE INVENTION

A device for paper transport of individual sheets and/or of endless webs in office machines comprises a printer frame including two side plates, a drive mechanism, a first support structure at the printer frame, and a second support structure at the printer frame. A first friction feed roll is rotatably supported by the side plates and driven by the drive mechanism and having a positively running bending line based on support forces exerted on the first friction feed roll generated by the first support structure at the printer frame. A second friction feed roll is rotatably supported by the side plates having a negatively running bending line based on support forces exerted on the second feed roll generated by the second support structure at the printer frame. The first friction feed roll and second friction feed roll are provided as a roll pair for transporting paper. The first friction feed roll and the second friction feed roll are tuned with a mechanical force to each other thereby influencing at least the course of one bending line such that the bending line of the first friction feed roll and the bending line of the second friction feed roll are running approximately parallel.

Preferably, the axis of each friction feed roll is bent such that the direction of the roll axis differs by less than 0.05 degrees when going from one roll end to the other.

The distances between the axis of the first friction feed roll and the axis of second friction feed roll over the length of the friction feed rolls can differ from an average value at each point by less than 1 percent of the smaller diameter of the friction feed rolls.

The distances between the axis of the first friction feed roll and the axis of second friction feed roll over the length of the friction feed rolls can differ from an average value at each point by less than 0.1 percent of the smaller diameter of the friction feed rolls.

A roll lever can be rotatably supported at the printer frame. Each friction feed roll can include rigidly attached rolls pins. One friction feed roll can be rotatably supported with the roll pins in the printer frame and a second oppositely disposed friction feed roll in each case can be rotatably supported at its roll pins with the roll lever. Tension springs can be hung into the roll lever in the printer frame supporting the second oppositely disposed friction feed roll.

The bending lines of the first and second friction feed roll can run along a parallel course with a positive curvature. The support force means can engage at the friction feed roll internally disposed relative to the positive bending line. Preferably, the support force means engages in the center region between the support forces furnished by the first support structure and the second support structure, respectively, whereby the friction feed roll running inwardly in the bending line course is subjected to a pretensioning.

A support roll can be supported at the printer frame for providing the support force in the center region. Compression springs can engage at a friction feed roll axis for supporting the support roll generating the support force in the center region. A circumferential recess in the internally disposed friction feed roll relative to the friction transport diameter can be employed in the paper transport for engaging the support roll.

A support carrier can be attached to the printer frame with clamping wings. The printer frame can be provided with a guide groove for the support carrier. The support roll generating the support force in the center region can be disposed together with the support spring in the separate support carrier.

A slider can be supported by the printer frame. A matrix print head can be supported on the slider for impacting with pins on the paper.

The first friction roll and the second friction roll can have a ratio of length to diameter from about 20:1 to 100:1. Preferably, the first friction roll and the second friction roll have a ratio of length to diameter from about 30:1 to 50:1. The diameter of the support roll can be from about 0.5 to one times the diameter of that one friction feed roll contacted by the support roll. The other friction feed roll can be supported by a spring pretensioned lever.

A method for transportation of paper, individual sheets and/or endless webs, in office machines wherein the office machine includes a printer frame including two side plates, a drive mechanism, and a first and a second support structure at the printer frame. A first friction feed roll is rotatably supported by the side plates and driven by the drive mechanism, having a positively running bending line based on support forces exerted on the first friction feed roll generated by the first support structure at the printer frame. A second friction feed roll is rotatably supported by the side plates having a negatively running bending line based on support forces exerted on the second feed roll generated by the second support structure at the printer frame. The method comprises the steps of constraining the first friction feed roll and second friction feed roll to be a roll pair for transporting paper, and tuning with a mechanical force the first friction feed roll and the second friction feed roll to each other thereby influencing at least the course of one bending line such that the bending line of the first friction feed roll and the bending line of the second friction feed roll are running approximately parallel.

The friction feed roll can engage with support force means internally disposed relative to the positive bending line. The support force means can engage in the center region between the support forces furnished by the first support structure and the second support structure, respectively, whereby the friction feed roll running inwardly in the bending line course can be subjected to a pretensioning.

A support roll can be supported at the printer frame for furnishing the support force in the center region. The support roll generating the support force in the center region can be elastically cushioned with compression springs engaging at a friction feed roll axis.

In accordance with the invention, the bending line of a first feed roll running positive by itself based on its support forces in the printer frame and the bending line of a second feed roll running negative by itself based on its support forces in the printer frame are tuned to each other such that the two bending lines run approximately parallel. This solution is more economic as compared to the known solutions because it requires a smaller number of parts and less expensive parts to be produced and kept in inventory and which solution provides uniformly high friction forces at the same time.

A particularly practical and advantageous embodiment of the invention results in case of an approximately parallel course and with a positive curvature of the bending lines of the first and of the second feed roll. With the feed roll disposed inwardly at the course of the bending line, a pretension is generated based on a support force engaging at the inner disposed feed roll, which support force engages in the center region between the two support forces. In this manner, a uniform friction can be generated over the entire length of the feed rolls.

According to a further feature of the invention, it is provided that, in each case, one feed roll is rigidly supported with its roll pin in the printer frame and the other oppositely disposed feed roll, in each case, one feed roll is rotatably supported at its roll pins with roll levers and with tension springs hung at these roll levers in the printer frame, where the roll levers are rotatably supported in the printer frame. This construction assures an advantageous and extremely accurate parallel position of the bending lines of the first and of the second feed roll.

According to further features of the invention it is provided that the support force present in the center region can be generated with a support roll supported at the printer frame. The support force can be transferred particularly advantageously in this case by the roller friction.

It is further disclosed that the support roll generating the support force in the center region is supported with compression springs engaging at a roll axis. The magnitude of the force can be set in this case via the compression springs, thereby achieving in addition a tuning of the tension springs hung at the roll levers.

Finally, the invention provides the improvement that the support roll generating the support force in the center region is disposed together with the compression springs in a separate support carrier and that the support carrier is attached in a print-support case with clamping wings, where further guide grooves are provided for the support carrier in the print-support casing. An exact position of the support roll is thereby maintained which contributes to the parallelism of the bending lines.

The novel features which are considered as characteristic for the invention are set forth in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

In the accompanying drawing, in which are shown several of the various possible embodiments of the present invention.

DESCRIPTION OF INVENTION AND PREFERRED EMBODIMENT

Figure 1:
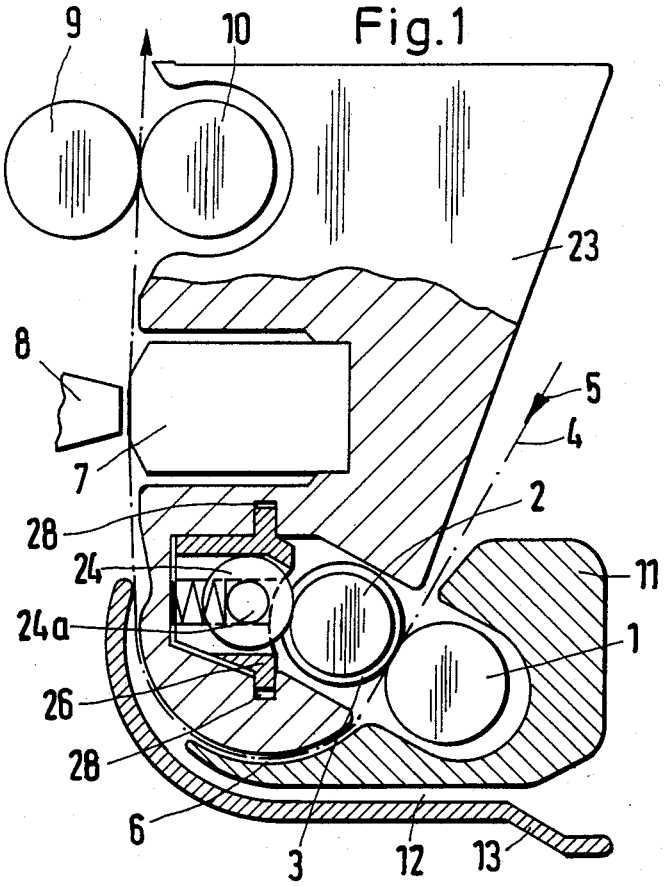
FIG. 1 is a cross-sectional view through the paper feed and the print support of a matrix printer.
Figure 5:
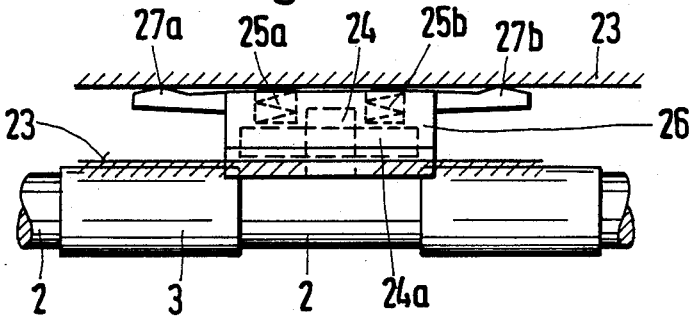
FIG. 5 is a partial horizontal sectional view through the part section with the support carrier.

A device for the paper transport of individual sheets and/or of endless webs in office machines, in particular in matrix printers, employs friction rolls rotatably supported on side plates and at least individually driven. These friction rolls are provided in pairs and exhibit a ratio of length to diameter from 30:1 to 50:1. The positively running bending line 16 of a first feed roll 1 based on its support forces 14*a*, 14*b* in the printer frame 15, and a negatively running bending line 17 of a second feed roll 2 in the printer frame 15 based on its support forces 14*a*, 14*b*, are tuned to each other such that the two bending lines 16, 22 are running approximately parallel.

In case of a parallel, positive course of the bending lines 16 or, respectively, 16*a* of the first and second feed roll 1, 2, the feed roll 2 running inwardly in the bending line course can be subjected to a pretensioning which can be generated based on a support force 21 engaging at the internally disposed feed roll 2. This support force 21 can engage in the center region 20 between the two support forces 14*a*, 14*b*.

One feed roll 2, in each case rigidly with its roll pins 2a, 2b, can be rotatably supported in the printer frame 15, where the second oppositely disposed feed roll 1 in each case can be rotatably supported at its roll pins 1a, 1b with a roll lever 18 and with tension springs 19 hung into the roll lever in the printer frame 15. The roll levers 18 can be rotatably supported in the printer frame 15.

The support force 21 provided in the center region 20 can be generated with a support roll 24 supported at the printer frame 15. The support roll 24 generating the support force 21 in the center region 20 can itself be supported by way of compression springs 25a, 25b engaging at a roll axis 24a.

The support roll 24 generating the support force 21 in the center region 20 can be disposed together with the support spring 25a, 25b in a separate support carrier 26. The support carrier 26 can be attached in a print support casing 23 by way of clamping wings 27a, 27b. The print support casing 23 can be provided with guide grooves 28 for the support carrier 26.

A device is required for an office machine such as for example a matrix printer, which is adapted to the remaining building blocks of the matrix printer and to their dimensions. A matrix printer comprises in its usual construction friction rolls which are rotatably supported in side plates and which operate as feed rolls 1 and 2. One or two of the feed rolls 1 and 2 are subjected to a rotary driving force. Corresponding to the length-/diameter ratio of from about 30:1 to 50:1, the feed roll 1, for example, has a support-force length of 480 mm and a diameter of 14 mm and the feed roll 2 has a diameter of 12 mm. In addition, axially slidable, elastic bushings 3 are disposed on the feed roll 2.

Individual sheets or endless lines of web material 4 to be printed on are guided in the direction 5 between the feed rolls 1 and 2 are transported out through a channel 6 ahead of a print support 7, on which the paper is well set and is printed on by the print head 8 and is transported away again by the friction rolls 9 and 10. The feed rolls 1 and 2 considered in this context are disposed within a paper guide body 11, which forms a further paper channel 12 with the aid of profiled rod 13, compare FIG. 1.

Figure 2:
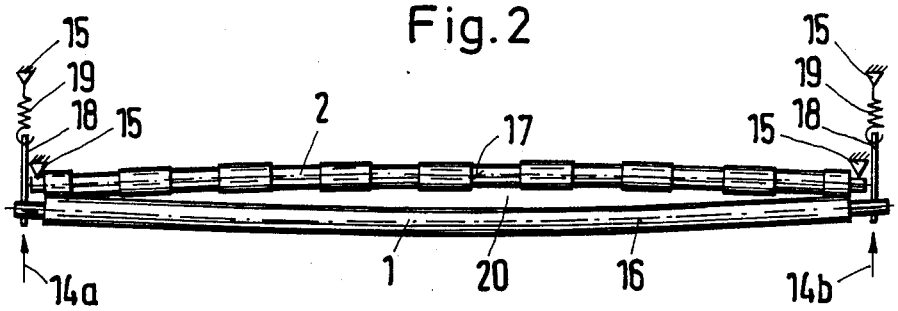
FIG. 2 is a view of two feed rolls with the bending-line course of two friction rolls without employing the features of the invention, illustrated with an approximately 100 times increase in the bending height level.

According to FIG. 2, the feed rolls 1 and 2 are illustrated without the invention features and there results a positive bending line 16 of the feed roll 1 based on the support forces 14a and 14b in the printer frame 15 and a negative bending line 17 of the feed roll 2. This difference is based on the attachment of the feed roll 1 with, in each case, a roll lever 18 and a tension spring 19 at the printer frame 15, where the feed roll 1 is springingly pressed via the roll lever 18 and the tension springs 19 against the feed roll 2.

Since the feed rolls 1 and 2 are very long and very thin and, based on the construction, the roll levers 18 can only be attached on the outside, the feed rolls 1 and 2 are pressed apart in the center region 20.

Figure 3:
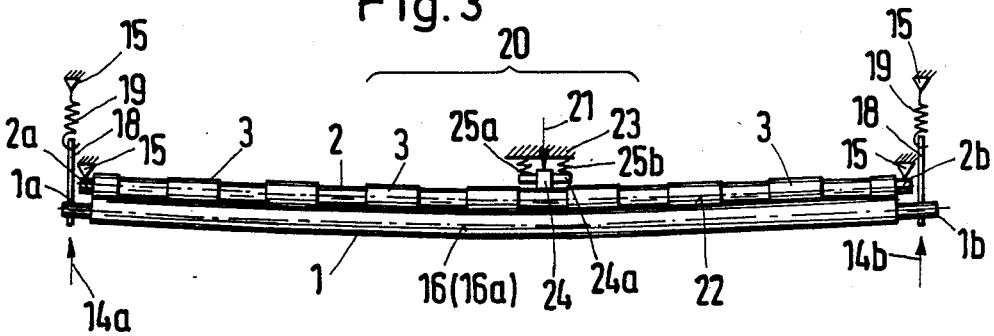
FIG. 3 is a view of the feed rolls with their bending-line course employing the invention, with an approximately 100 times increase in the bending height level.
Figure 4:
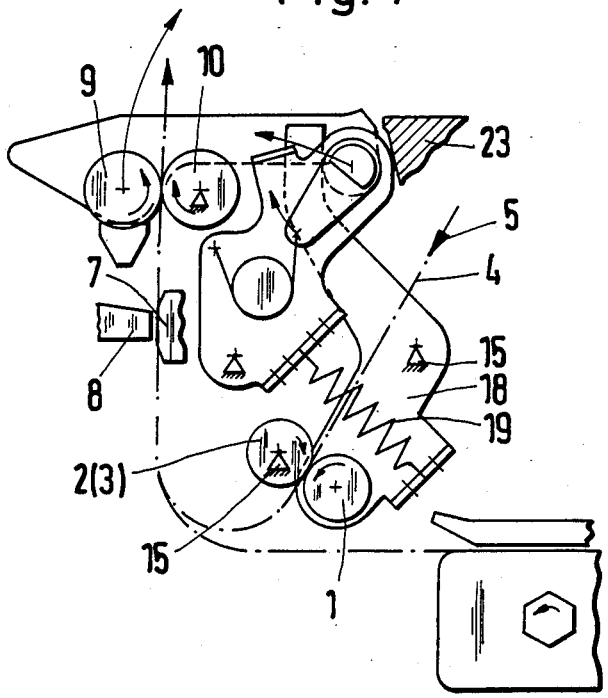
FIG. 4 is a partial cross-section through the region of the roll pins with the roll levers.

A support force 21 is applied in the center region 20 against the feed roll 2 based on the feature of the invention as illustrated in FIG. 3 such that the negatively running bending line 17 is transformed into a positively running bending line 22. The support force 21 can be calculated or can be determined empirically be experiment. In this case, the bending lines 16 and 22 have a course which is substantially parallel. An increase of the support force 21 results in a pretension, where the feed rolls 1 and 2 rest safely over their full length against each other. Consequently, the fed-in individual sheet or endless line of web material 4 are pressed and driven over their full width. The roll pins 2a and 2b are rigidly supported in the printer frame 15, the roll pins 1a and 1b of the feed roll 1 are supported via the roll levers 18 and the tension springs 19 at the printer frame 15, where the roll levers 18 are rotatably attached in the side plates of the printer frame 15. The support force 21 in the center region 20 is generated with a support roll 24 supported at the printer frame 15 or, respectively, at a print-support casing 23. The roll axis 24a is supported via compression springs 25a and 25b. The support roll 24 and the compression springs 25a and 25b are received in a separate support carrier 26. The support carrier 26 is attached in the print-support casing 23 with clamping wings 27a and 27b which engage in guide grooves 28.

The diameter of the support roll 24 can be from about 0.5 to 1 times the diameter of the feed roll 2 and is preferably from about 0.8 to 0.95 times the diameter of the feed roll 2. A number of support rolls 24 can be provided and their length can be from about 1/20 to 1/5 of the full length of the feed roll 2 and is preferably from about 1/10 to ⅛ of the length of the feed roll 2.

It will be understood that each of the elements described above, or two or more together, may also find a useful application in other types of office machines differing from the types described above.

While the invention has been illustrated and described as embodied in the context of a device for the paper transport of single sheets and/or continuous paper in office machines, in particular in matrix printers, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A device for paper transport of individual sheets and/or endless webs in office machines comprising a printer frame including two side plates;

a drive mechanism;

a first support structure at the printer frame;

a second support structure at the printer frame;

a first friction feed roll rotatably supported by the side plates and driven by the drive mechanism and having a positively running bending line based on support forces exerted on the first friction feed roll generated by the first support structure at the printer frame;

a second friction feed roll rotatably supported by the side plates having a negatively running bending line based on support forces exerted on the second friction feed roll generated by the second support structure at the printer frame where the first friction feed roll and second friction feed roll are provided as a roll pair for transporting paper; and tuning means for tuning the first friction feed roll and the second friction feed roll with a mechanical force to each other thereby influencing the course of at least one bending line such that the bending line of the first friction feed roll and the bending line of the second friction feed roll are running approximately parallel;

compression springs engaging at a friction feed roll axis for supporting the support roll generating the support force in the center region; and a circumferential recess in the internally disposed friction feed roll relative to a diameter employed in the paper transport for engaging the support roll.

2. The device for paper transport according to claim 1 wherein the axis of each friction feed roll is bent such that the direction of the roll axis differs by less than 0.05 degrees when going from one roll end to the other.

3. The device for paper transport according to claim 1 wherein the distances between the axis of the first friction feed roll and the axis of second friction feed roll over the length of the friction feed rolls differs from an average value at each point by less than 1 percent of the smaller diameter of the friction feed rolls.

4. The device for paper transport according to claim 1 wherein the distances between the axis of the first friction feed roll and the axis of second friction feed roll over the length of the friction feed rolls differs from an average value at each point by less than 0.1 percent of the smaller diameter of the friction feed rolls.

5. The device for paper transport according to claim 1 further comprising a roll lever rotatably supported at the printer frame; wherein each friction feed roll includes rigidly attached roll pins and wherein one friction feed roll is rotatably supported with the roll pins in the printer frame and wherein a second oppositely disposed friction feed roll in each case is rotatably supported at its roll pins with the roll lever;

tension springs hung into the roll lever in the printer frame supporting the second oppositely disposed friction feed roll.

6. The device for paper transport according to claim 1 wherein the bending lines of the first and second friction feed roll run along a parallel course and wherein the curvature of the bending lines is positive; further comprising support force means engaging at the friction feed roll internally disposed relative to the positive bending line and wherein the tuning means engages in the center region between the support forces furnished by the first support structure and the second support structure, respectively, whereby the friction feed roll running inwardly in the bending line course is subjected to a pretensioning.

7. The device for paper transport according to claim 6 further comprising a support roll supported at the printer frame for providing the support force in the center region.

8. The device for paper transport according to claim 1 further comprising clamping wings;

a support carrier attached to the printer frame with the clamping wings, wherein the printer frame is provided with a guide groove for the support carrier and wherein the support roll generating the support force in the center region is disposed together with the support spring in the separate support carrier.

9. The device for paper transport according to claim 1 further comprising a slider supported by the printer frame;

a matrix print head supported on the slider for impacting with pins on the paper.

10. The device for paper transport according to claim 1 wherein the first friction roll and the second friction roll have a ratio of length to diameter from about 20:1 to 100:1.

11. The device for paper transport according to claim 1 wherein the first friction roll and the second friction roll have a ratio of length to diameter from about 30:1 to 50:1 and wherein the diameter of the support roll is from about 0.5 to one times the diameter of that one friction feed roll contacted by the support roll and wherein the other friction feed roll is supported by a spring pretensioned lever.

12. Device for the paper transport of individual sheets and/or of endless webs in office machines, in particular in matrix printers, employing friction rolls rotatably supported on side plates and at least individually driven, which friction rolls are provided in pairs and which exhibit a ratio of length to diameter from 30:1 to 50:1, wherein the positively running bending line (16) of a first feed roll (1) based on its support forces (14*a*, 14*b*) in the printer frame (15), and a negatively running bending line (17) of a second friction feed roll (2) in the print frame (15) based on its support forces (14*a*, 14*b*), are tuned with a mechanical force of a tuning means to each other thereby influencing the course of at least one bending line such that the two bending lines (16, 22) are running approximately parallel; and wherein a support force (21) provided in the center region (20) is generated with a support roll (24) supported at the printer frame (15); and wherein the support roll (24) generating the support force (21) in the center region (20) is supported itself by way of compression springs (25*a*, 25*b*) engaging at a roll axis (24*a*).

13. The device according to claim 12 wherein the bending lines (16 or, respectively, 16*a*) of the first and second friction feed roll (1, 2) have a positive curvature and a parallel course with the friction feed roll (2) running inwardly in the bending line course is subjected to a pretensioning which can be generated based on a support force (21) engaging at the internally disposed friction feed roll (2) and which support force (21) of the tuning means engages in the center region (20) between the two support forces (14*a*, 14*b*).

14. Device according to claim 12, wherein one feed roll (2) in each case rigidly with its roll pins (2*a*, 2*b*) is rotatably supported in the printer frame (15) and where the second oppositely disposed friction feed roll (1) in each case is rotatably supported at its roll pins (1*a*, 1*b*) with a roll lever (18) and with tension springs (19) hung into the roll lever in the printer frame (15), where the roll levers (18) are rotatably supported in the printer frame (15).

15. Device according to claim 12, wherein the support roll (24) generating the support force (21) in the center region (20) is disposed together with the support spring (25*a*, 25*b*) in a separate support carrier (26) and where the support carrier (26) is attached in a print support casing (23) by way of clamping wings (27*a*, 27*b*), where the print support casing (23) is provided with guide grooves (28) for the support carrier (26).

16. A method for transportation of paper, individual sheets and/or endless webs, in office machines wherein the office machine includes a printer frame including two side plates;
a drive mechanism;
a first support structure at the printer frame;
a second support structure at the printer frame;
a first friction feed roll rotatably supported by the side plates and driven by the drive mechanism and having a positively running bending line based on support forces exerted on the first friction feed roll generated by the first support structure at the printer frame; and
a second friction feed roll rotatably supported by the side plates having a negatively running bending line based on support forces exerted on the second friction feed roll generated by the second support structure at the printer frame;
compression springs engaging at a friction feed roll axis for supporting the support roll generating the support force in the center region; and a circumferential recess in the internally disposed friction feed roll relative to a diameter employed in the paper transport for engaging the support roll comprising the steps of
constraining the first friction feed roll and second friction feed roll to be a roll pair for transporting paper;
tuning the first friction feed roll and the second friction feed roll with a mechanical force furnished by a tuning means to each other and thereby influencing the course of at least one bending line such that the bending line of the first friction feed roll and the bending line of the second friction feed roll are running approximately parallel relative to each other.

17. The method for transportation of paper according to claim 16 further comprising engaging at the friction feed roll with support force means internally disposed relative to the positive bending line and wherein the tuning means providing a support force engages in the center region between the support forces furnished by the first support structure and the second support structure, respectively, whereby the friction feed roll running inwardly in the bending line course is subjected to a pretensioning.

18. The method for transportation of paper according to claim 16 further comprising
supporting a support roll at the printer frame for furnishing the support force in the center region; and
elastically cushioning the support roll generating the support force in the center region with compression springs engaging at a friction feed roll axis

19. A device for paper transport of individual sheets and/or of endless webs in office machines comprising
a printer frame including two side plates;
a drive mechanism;
a first support structure at the printer frame;
a second support structure at the printer frame;
a first friction feed roll rotatably supported by the side plates and driven by the drive mechanism and having a first bending line based on support forces exerted on the first friction feed roll generated by the first support structure at the printer frame;
a second friction feed roll rotatably supported by the side plates having second bending line based on support forces exerted on the second friction feed roll generated by the second support structure at the printer frame where the first friction feed roll and second friction feed roll are provided as a roll pair for transporting paper and where the first friction feed roll and the second friction feed roll are tuned with a tuning means exerting a mechanical force toward each other thereby changing the course of at least one of the bending lines such that the bending line of the first friction feed roll and the bending line of the second friction feed roll are running approximately parallel.

20. A device for paper transport of individual sheets and/or of endless webs in office machines comprising
a printer frame including two side plates;
a drive mechanism;
a first support structure at the printer frame;
a second support structure at the printer frame;
a first friction feed roll rotatably supported by the side plates and driven by the drive mechanism and having a first bending line based on support forces exerted on the first friction feed roll generated by the first support structure at the printer frame;
a second friction feed roll rotatably supported by the side plates having a second bending line based on support forces exerted on the second friction feed roll generated by the second support structure at the printer frame where the first friction feed roll and second friction feed roll are provided as a roll pair for transporting paper; and
tuning means for tuning the first friction feed roll and the second friction feed roll with a mechanical force to each other thereby influencing the course of at least one bending line such that the bending line of the first friction feed roll and the bending line of the second friction feed roll are running approximately parallel;
compression springs engaging at a friction feed roll axis for supporting the support roll generating the support force in the center region; and
a circumferential recess in the internally disposed friction feed roll relative to a diameter employed in the paper transport for engaging the support roll.

* * * * *